United States Patent [19]

Tarullo

[11] 4,236,505

[45] Dec. 2, 1980

[54] FORCED DROPLET HUMIDIFIER

[75] Inventor: Daniel J. Tarullo, 71 Coventry Ct., Voorheesville, N.Y. 12186

[73] Assignee: Daniel J. Tarullo, Voorheesville, N.Y.

[21] Appl. No.: 15,815

[22] Filed: Apr. 4, 1979

[51] Int. Cl.[3] ..... F24H 1/00

[52] U.S. Cl. ..... 126/350 B; 126/113

[58] Field of Search ..... 126/113, 350 B; 261/105, 126

[56] References Cited

U.S. PATENT DOCUMENTS 3,285,586 11/1966 Powers ..... 126/113 X 3,873,806 3/1975 Schossow ..... 126/113 X

*Primary Examiner*—George T. Hall

[57] ABSTRACT

A forced droplet humidifier. The unit contains a float device to regulate and supply water, and adjustable lift or suction tube in which droplets of water are introduced, suspended and evaporated into a furnace air stream. A furnace air supply enters one side of the unit and the force of the supply air from the furnace in conjunction with the return lift or suction air creates an atmosphere which lifts and evaporates water droplets in the lift or suction tube. The vaporized air is then forced into the area to be humidified. Accumulated sediment settles to the bottom of the device.

3 Claims, 3 Drawing Figures

FORCED DROPLET HUMIDIFIER

This invention relates to a new and improved humidifier for heating systems.

One difficulty presently encountered in heating systems for buildings is the inability of the heating system to deliver an adequate amount of moisture conducive to good health and proper humidity with the heated air. There have been many types of humidifiers made and tried throughout the years. Some of these prior humidifiers were associated with furnaces or central heating plants and still others were used independently of a heating system. During the heating season, buildings often lack proper moisture causing the building materials to dry out. Dryness also is conducive to respiratory ailments in humans, and creates a condition of undesirable static electricity. The humidifier of this invention overcomes these undesirable conditions.

It is, therefore, a principal object of this invention to provide a novel humidifier for forced air central heating systems.

An important object of this invention is to provide a novel device producing an indoor humidity directly related to the heat supplied to heat a building.

Another important object of this invention is to provide a new and novel humidifier for use with heating systems which use gas, oil, or other instantly ignitable fuels which are operable in response to thermostats or other automatic control mechanisms.

This invention is a humidifier of a different and unique operation. Present day humidifiers use a media pad which must be replaced regularly due to evaporation of minerals in the water. The efficiency of the units declines quickly because of this problem. The esisting types also need a power source, electric motors, etc. needed for unit operation. Maintenance and also the initial cost of the units are high.

The forced droplet type is so simple that the only moving part is a water inlet float. No power is needed to operate it except the cool and hot air output of the furnace itself.

Other and further important objects and advantages will become apparent from the disclosures in the following specification and accompanying drawing.

In the drawing

Figure 3:
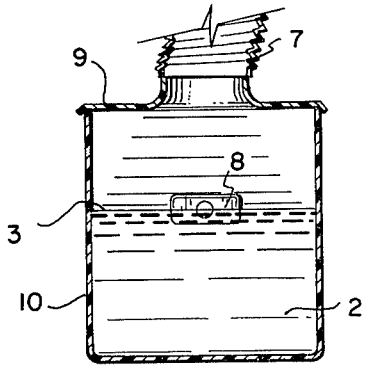
FIG. 3 is a sectional end view taken through the humidifier.
Figure 1:
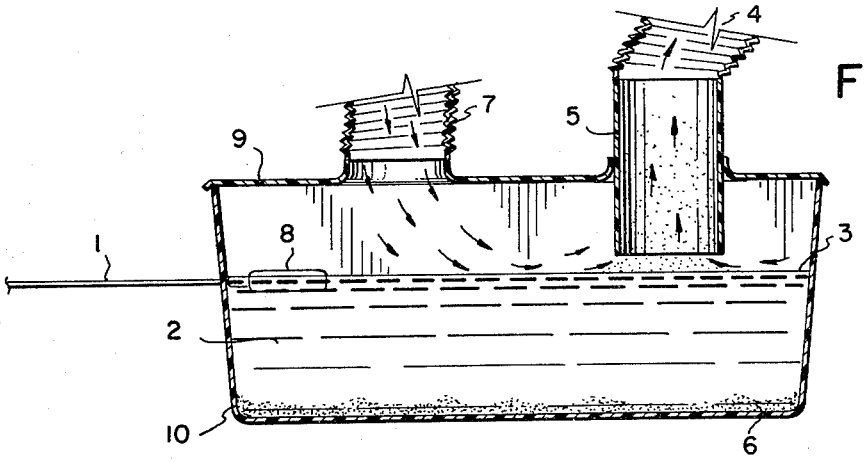
FIG. 1 is a sectional side view taken through the humidifier.
Figure 2:
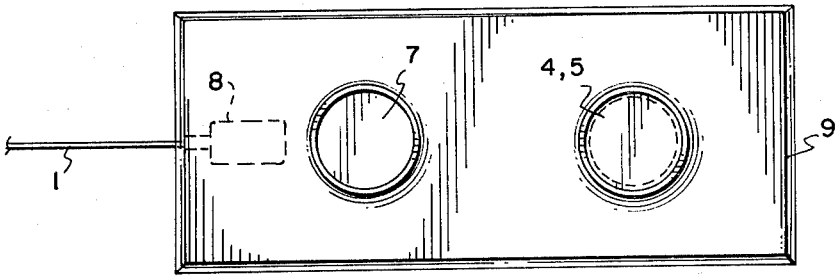
FIG. 2 is a top view of the humidifier.

The reference numeral 10 indicates the container or main body of the humidifier.

The humidifier can be floor or furnace mounted. However, a floor mounted version is more desirable due to the weight of the water in the unit.

The operation of the device is as follows:

Water is supplied through a fill line 1. This fill line is connected to a water line.

Water enters the main body through an adjustable valve and float assembly 8.

When a water level of approximately ½ volume is reached in the container, the float stops the flow of water.

The size of the container 10 and 8 is proporitional to the size of the furnace to which it is attached.

The various other items of this invention are also proporitional.

The device described herein will humidify a dwelling of 1800 sq. ft. For reference only, the size of the device described herein is approximately 14"×8"×8".

A removable plastic cover 9 is then placed on the plastic body 10.

The plastic body is constructed of a clear plastic to allow visual adjustment of water level, float level, and suction tube levels.

The holes are cut into the top cover to accept flexible corrigated tubing 4" in diameter or proporitionally larger.

These are referred as items 4 and 7.

Item 7 has flexible tubing running from the hot air side of a hot air furnace.

Item 4 has a flexible tube running into the return air section of a hot air furnace.

A suction tube 5 is inserted into the return air hole on the cover.

This tube shall be clear plastic for visual viewing of the water droplets. The suction tube shall be adjustable for up or down operation.

A lock ring with a screw lock holds suction tube 5 at desirable levels above the water in the main body of the device 3.

When the furnace is on, hot air from tube 7 flows into the humidifier body 10.

This hot air is then forced up through the suction tube 5 and then into the return air side of the furnace through suction tube 5 and flexible tube 4.

This flow creates a strong suction which raises droplets of water at suction tube 5.

These droplets rise and fall within the suction tube approximately 3" to 5".

The droplets are temporarily suspended and evaporated completely and are returned to the water partially evaporated.

The mineral fallout settles to the bottom of the container 6.

These minerals occur during hardwater usage. The minerals are easily removed at a later date and in no way hinder the operation of the device.

Warm moist air is thusly created which in turn flow into the home or building that is being humidified.

Suction tube 5 can be adjusted to permit maximum or minimum humidification simply by raising or lowering the tube above the water level 3.

I claim:

1. A forced droplet humidifier comprising a main body having a float valve to regulate the water supply and level, a removable cover for said body having two openings therein, one for a hot air supply and one for a suction tube, the suction tube being adjustably mounted in a collar so that the bottom of the tube is elevated above the water level to receive water droplets and vapor into the suction tube by the force air operation of a furnace.

2. The humidifier of claim 1 wherein the cover supports the supply and return air connections for operation of the suction tube.

3. The humidifier of claim 1 wherein the suction tube is installed above a water supply of a distance which equals less than the total area of the diameter of the tube creates a suction on the water surface.

* * * * *